US005521359A

United States Patent [19]

Bone

[11] Patent Number: 5,521,359

[45] Date of Patent: May 28, 1996

[54] SYSTEM FOR COORDINATING OPERATION OF MICROWAVE OVEN WITH A SECOND APPLIANCE

[76] Inventor: Charles A. Bone, 235 Sandringham Ct., Knoxville, Tenn. 37922

[21] Appl. No.: 423,974

[22] Filed: Apr. 18, 1995

[51] Int. Cl.[6] ..... H05B 6/68

[52] U.S. Cl. ..... 219/679; 219/718; 219/723; 219/485; 219/486; 307/41; 361/88

[58] Field of Search ..... 219/679, 715, 219/716, 718, 721, 723, 485, 486; 307/41, 38, 39; 361/88, 91, 93, 99, 22

[56] References Cited

U.S. PATENT DOCUMENTS

| | | | |
|---|---|---|---|
| 3,846,641 | 11/1974 | Eguchi | 307/41 |
| 4,198,553 | 4/1980 | Dills | 219/718 |
| 4,472,640 | 9/1984 | Elmer | 307/41 |
| 4,777,379 | 10/1988 | Young | 307/41 |
| 4,847,722 | 7/1989 | Bennett | 361/31 |
| 4,880,954 | 11/1989 | Bennett et al. | 219/718 |
| 4,958,055 | 9/1990 | Shim | 219/486 |
| 5,270,578 | 12/1993 | Yamamura | 307/39 |

*Primary Examiner*—Philip H. Leung
*Attorney, Agent, or Firm*—Michael E. McKee

[57] ABSTRACT

An electrical control scheme which permits operating power for a microwave oven and a second electrical appliance, such as a refrigerator, to be withdrawn from a single electrical outlet utilizes electrical contacts across which a voltage differential is generated when the oven is in operation and includes wiring connected between the second electrical appliance and the microwave oven. The included wiring conducts electrical power to the second electrical appliance from the power cord of the microwave oven, and the control system further includes a relay having a normally-closed switch. The switch of the relay is connected in line with the included wiring, and the coil of the relay is connected across the aforementioned electrical contacts of the microwave oven and is responsive to the voltage differential generated across the contacts during microwave oven operation so that as long as the microwave oven is operating, the switch of the relay prevents electrical power to be withdrawn by the second electrical appliance through the wiring and as long as the microwave oven is not operating, the switch of the relay permits electrical power to be withdrawn by the second electrical appliance through the wiring.

16 Claims, 3 Drawing Sheets

SYSTEM FOR COORDINATING OPERATION OF MICROWAVE OVEN WITH A SECOND APPLIANCE

BACKGROUND OF THE INVENTION

This invention relates generally to the operation of a microwave oven and a second electrical appliance and, more particularly, is concerned with the withdrawal of electrical power by a microwave oven and a second appliance from the same electrical outlet.

It is known that the startup and operating current requirements for conventional microwave ovens and some other electrical appliances, such as refrigerators, can be relatively high. To avoid the relatively high peak power demands associated with the simultaneous operation of a microwave oven and a second electrical appliance, it is common that a single outlet wall receptacle is dedicated to the operation of the microwave oven while the second appliance is operated from a different outlet. In places in which electrical outlets are relatively scarce, such as in a dormitory room, it would be advantageous to provide means which enable a microwave oven and a second electrical appliance, such as a refrigerator, to be operated from the same electrical outlet yet avoid the relatively high peak power demands normally associated with the simultaneous operation of the oven and the second appliance.

Heretofore, electrical control schemes have been devised which enable a microwave oven and a second appliance, such as a refrigerator, to withdraw power from the same electrical power outlet but prevent simultaneous operation of the two items. For example, U.S. Pat. No. 4,880,954 describes a control scheme wherein power from a single outlet receptacle can be used to operate a microwave oven and a refrigerator, but such a scheme involves a timer-operated control switch and is believed to be adaptable only to microwave ovens whose operation is initiated by mechanical timers. It would therefore be desirable to provide an electrical control scheme which prevents a microwave oven and a second appliance, such as a refrigerator, to operate simultaneously from a single outlet receptacle yet is adaptable to other types of microwave ovens, such as those which employ an electronic controller, e.g. a printed circuit board, and whose operation is initiated, for example, by the actuation of touch-membrane switches.

Accordingly, it is an object of the present invention to provide a new and improved control system for coordinating the operation of a microwave oven and a second electrical appliance from a single electrical power outlet.

Another object of the present invention is to provide such a system which enables a microwave oven and a second electrical appliance to be operated from a single electrical outlet yet prevents the simultaneous operation of the microwave oven and the second appliance.

Still another object of the present invention is to provide such a system which is particularly well-suited for use when operating a refrigerator in conjunction with a microwave oven.

Yet another object of the present invention is to provide such a system which is uncomplicated in construction and effective in operation.

SUMMARY OF THE INVENTION

This invention resides in a control system for coordinating the operation of a microwave oven with that of a second electrical appliance enabling the microwave oven and the second electrical appliance to withdraw electrical power for operation from a single electrical power outlet and wherein the microwave oven includes a pair of electrical contacts across which a voltage differential is generated when the microwave oven is in operation and a power cord through which electrical power is conducted to the electrical contacts from the single power outlet.

The control system includes wiring connected between the second electrical appliance and the microwave oven for conducting electrical operating power to the second electrical appliance by way of the power cord. Also included within the system are relay means having a normally-closed switch which is connected in line with the wiring connected between the second electrical appliance and the microwave oven and including a coil connected across the electrical contacts of the microwave oven. By way of the coil, the switch of the relay means is responsive to the voltage differential generated across the aforementioned electrical contacts during microwave oven operation so that as long as the microwave oven is operating, the switch of the relay means prevents electrical power to be withdrawn by the second electrical appliance through the wiring and as long as the microwave oven is not operating, the switch of the relay means permits electrical power to be withdrawn by the second electrical appliance through the wiring. Thus, the switch of the relay means prevents simultaneous operation of the microwave oven and the second electrical appliance.

In one embodiment of the invention, the wiring of the control system includes an outlet receptacle into which the plug of a power cord can be inserted. Such an embodiment is well-suited for use in the instance in which the second appliance includes its own power cord because the receptacle accommodates the manual disconnection (or re-connection) of the second electrical appliance from the power cord of the microwave oven.

DETAILED DESCRIPTION OF THE ILLUSTRATED EMBODIMENTS

Figure 1:
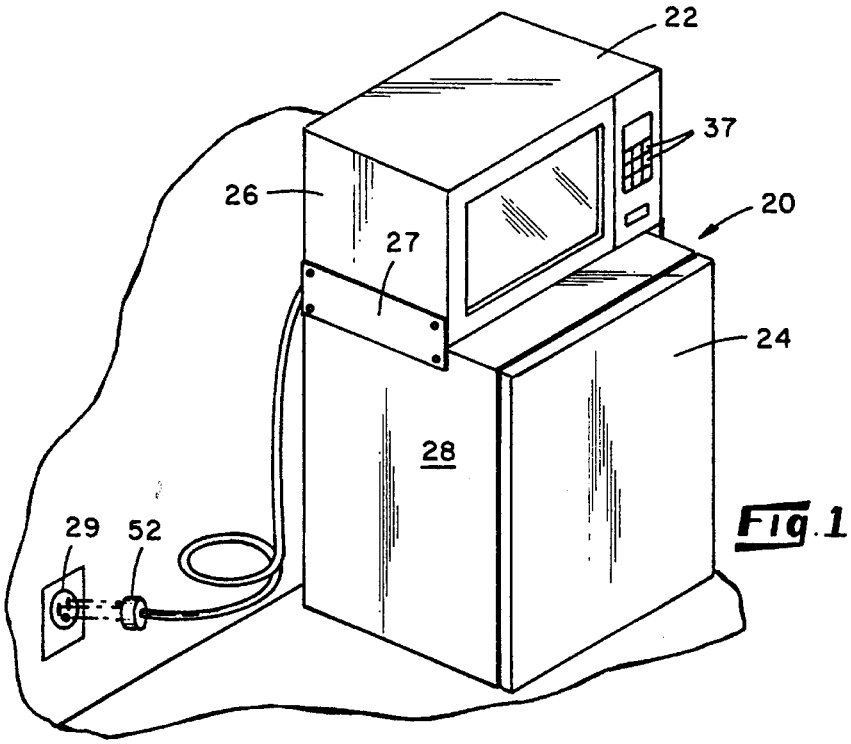
FIG. 1 is a perspective view of a combined microwave oven and refrigerator within which features of the present invention are embodied.

Turning now to the drawings in greater detail and considering first FIG. 1, there is shown an appliance 20 comprising, in combination, a microwave oven 22 and a refrigerator 24. In the depicted embodiment 20, the microwave oven 22 includes a cabinet 26 which is securely mounted atop the cabinet, indicated 28, of the refrigerator 24 by means of brackets 27 (only one shown in FIG. 1), and the principal working components of each of the oven 22 and refrigerator 24 are electrically-powered. The appliance 20 also includes a control system 30 (FIG. 2) which enables the oven 22 and refrigerator 24 to withdraw electrical power from a single wall outlet receptacle 29 while preventing the simultaneous operation of the oven 22 and the refrigerator 24. In the depicted example, the receptacle 29 is a standard 120 VAC outlet adapted to receive a standard three-pronged plug 52.

The working components and operating principles of each of the microwave oven 22 and the refrigerator 24 are well-known in the art so that a detailed description of those components and principles is not believed to be necessary. Suffice it to say that within the oven 22 (and with reference to FIG. 2), the working components include a magnetron 32 (FIG. 2) and a blower 34, and operation of the oven components are controlled by way of a magnetron circuit 33 and a controller 35 having manually-accessible contact, i.e. touch-membrane, switches 37 (FIG. 1). The controller 35 of the depicted oven 22 includes a printed circuit board (not shown in FIG. 2) as well as safety features, such as a door switch 31 which prevents operation of the oven 22 if the oven door is open. Operation of the oven is initiated by way of the switches 37. Within the refrigerator 24, the working components include a compressor 36 and a condenser fan 38, and operation of the refrigerator compressor and fan 38 is controlled by means of a thermostat 40 suitably mounted within the refrigerator cabinet 28.

As mentioned earlier, the control system 30 (FIG. 2) enables the oven 22 and refrigerator 24 to withdraw electrical power from a single wall outlet receptacle 29 while preventing the simultaneous operation of the oven 22 and the refrigerator 24. It will be noted, however, that within some microwave ovens, power is withdrawn for purposes of operating small-power consuming items, such as a clock, as long as electrical power is withdrawn from a wall receptacle by way of the power cord of the microwave oven. However, in the interests of the present invention, the microwave oven is considered to be in "operation" only when its principal power-consuming components, i.e. the magnetron 32 and/or its blower 34 is operating. Since it is the effects of the simultaneous withdrawal of power by multiple high-power consuming components, i.e. those of the microwave oven and a second electrical appliance, that this invention is intended to circumvent, it is of no consequence that the small-power consuming items of the microwave oven, such as a clock, may continue to operate while the magnetron and blower are shut off. Along the same lines, the microwave oven is considered as "not operating" in the interests of the present invention when its principal power-consuming components, e.g. the magnetron and blower, cease to withdraw power for operation.

Figure 2:
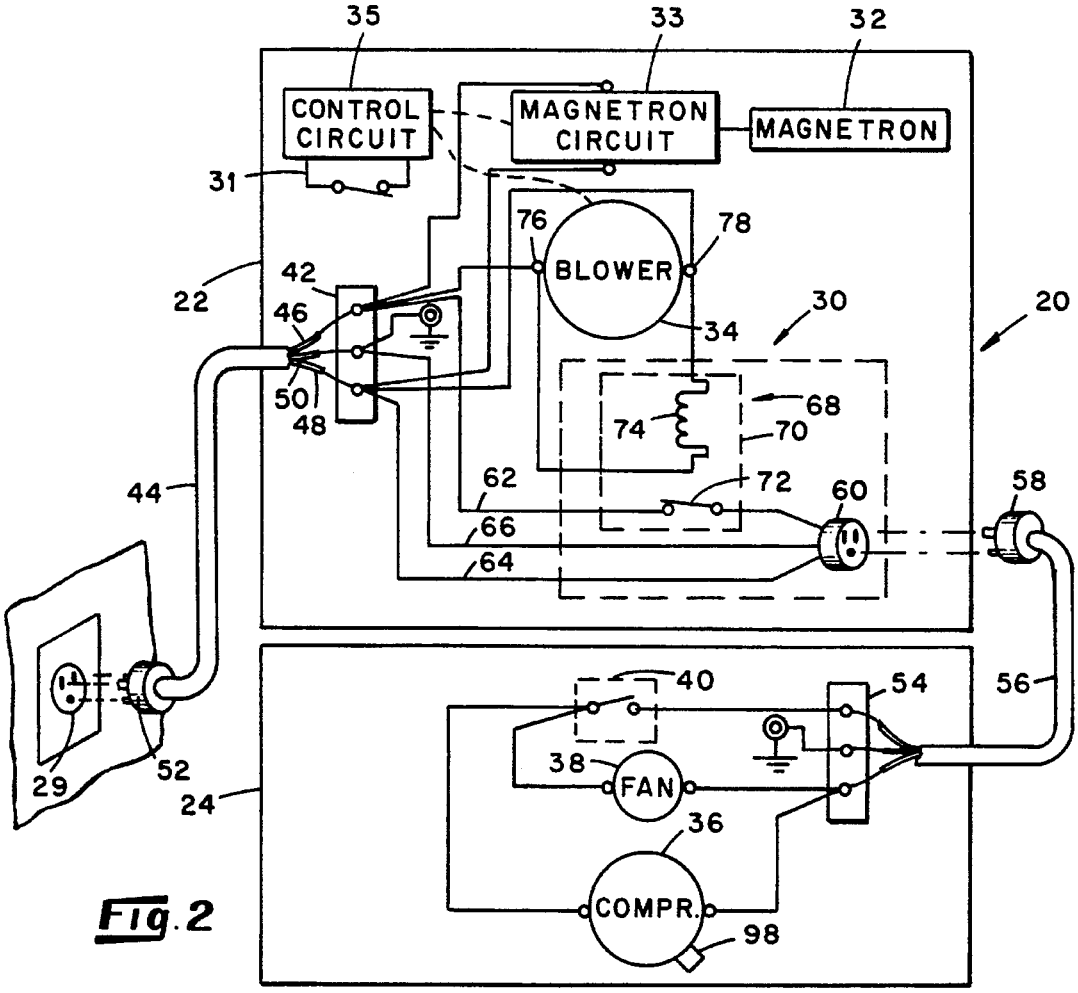
FIG. 2 is a view illustrating schematically the operation of the FIG. 1 combination.

With reference still to FIG. 2, the microwave oven 22 is provided with a terminal block 42 and a power cord 44 connected so as to route electrical power from the outlet receptacle 29 to the terminal block 42. To this end, the power cord 44 includes two power wires 46, 48 and a ground wire 50 which are operatively connected between a three-pronged plug 52 adapted to be received by the outlet receptacle 29 and the terminal block 42. The magnetron 32 and blower 34 are, in turn, appropriately wired to the terminal block 42 for receiving operating power conducted thereto by way of the cord 44.

The refrigerator 24 of the depicted embodiment is also provided with a terminal block 54 and a power cord 56 extending between the terminal block 54 and a three-pronged plug 58. The refrigerator compressor 36 and condenser fan 38 are, in turn, appropriately wired to the terminal block 54 for receiving operating power conducted thereto by way of the cord 56.

In order that the control system 30 enables the refrigerator 24 to withdraw the electrical power required for refrigerator operation from the single outlet receptacle 29 by way of the power cord 44, the control system 30 includes an outlet receptacle 60 mounted adjacent the cabinet 26 of the microwave oven 22 for receiving the three-prong plug 58 of the refrigerator power cord 56 and a series of wires 62, 64 and 66 extending between the receptacle 60 and the terminal block 42 of the microwave oven 22. Two wires 62 and 64 are power-conducting wires while the remaining wire 66 is a ground wire.

The control system 30 also includes relay means, generally indicated 68, in the form of an electrical relay 70 which is connected between the power wire 62 and two contacts of the microwave oven 22 across which a voltage is passed during operation of the oven 22. More specifically, the relay 70 includes a normally-closed switch 72 which is connected in-line with the power wire 62 and a coil 74 which is connected to two electrical contacts across which a voltage differential is generated during operation of the microwave oven 22. Although the relay coil 74 can be connected to any of a number of pairs of electrical contacts within the oven 22, the coil 74 of the depicted embodiment is connected across the power leads 76, 78 of the oven blower 34. Thus, as long as the blower 34 is OFF, the normally-closed switch 72 remains closed, and upon switching of the blower ON by the application of power across the leads 76, 78, the switch 72 is moved by the relay coil 74 to an opened position.

It follows from the foregoing that as long as the microwave oven 22 is not in operation, the relay switch 72 is in a closed condition so that electrical power can be transmitted between the terminal block 42 of the microwave oven 22 and the outlet receptacle 60 for use by the refrigerator 24. Thus, electrical power can be withdrawn by the components of the refrigerator 24 through the power cords 44 and 56 as long as the microwave oven 22 or, in particular, the blower 34 of the microwave oven 22 is not operating. If, on the other hand, the microwave oven 22 is operating so that sufficient voltage is applied across the power leads 76, 78 of the blower 34, the relay coil 74 opens the relay switch 72 to thereby prevent power from flowing through the power wire 62. Consequently, as long as the microwave oven 22 is operating, the refrigerator components 36 and 38 are prevented from withdrawing electrical power through the receptacle 60 and are thereby prevented from operating. Thus, relatively high peak power demands which may otherwise be experienced with the simultaneous operation of the microwave oven 22 and the refrigerator 24 by way of a single electrical outlet 29 are avoided by the control system 30, and the system 30 is advantageous in this respect.

Figure 3:
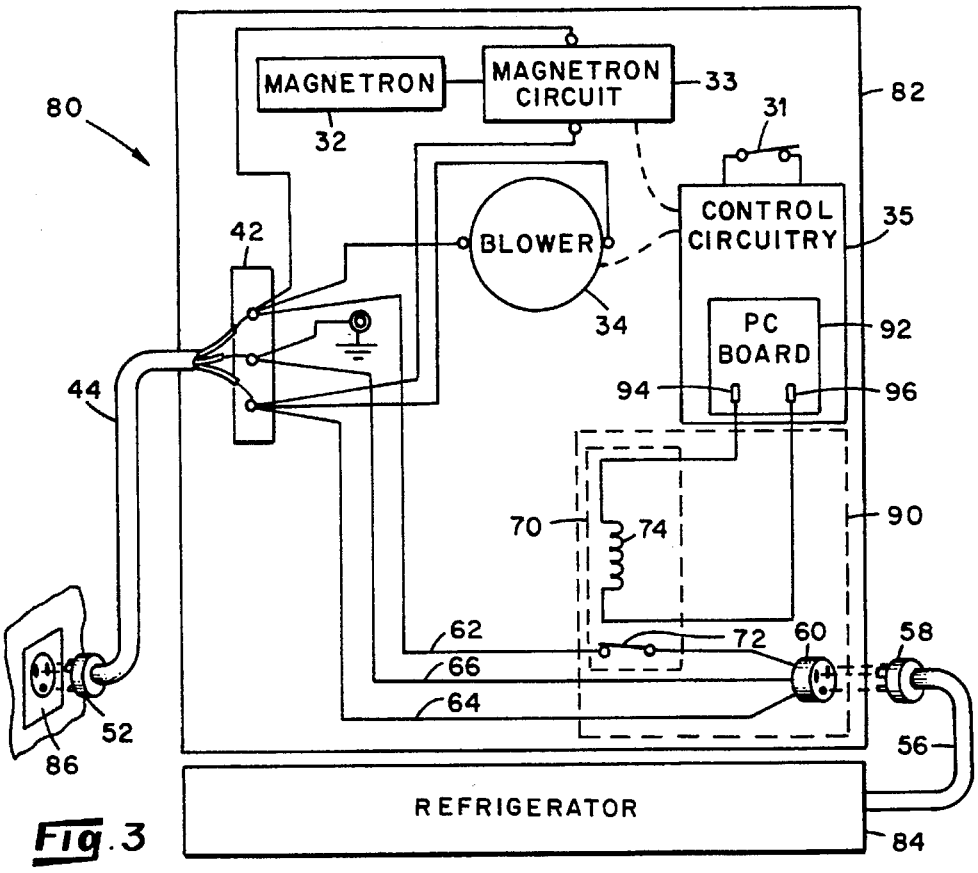
FIG. 3 is a view illustrating schematically the operation of another refrigerator/microwave oven combination within which another embodiment of the invention is utilized.

As mentioned earlier, the coil 74 of the relay 70 can be connected to any of a number of pairs of electrical contacts within the oven 22 so that the switch 72 opens upon operation of the oven 22. For example, there is shown in FIG. 3 an alternative appliance 80 including a microwave oven 82 and a refrigerator 84 connected together for withdrawing power for operation by way of the power cord of the microwave oven 82 and a control system 90 for preventing simultaneous operation of the oven 82 and refrigerator 84. The microwave oven 82 and refrigerator 84 include many of the identical components as those of the microwave oven 22 and refrigerator 24 of the FIG. 1 appliance 20 and, accordingly, bear the same reference numerals.

As is the case with the control system 30 of the FIG. 1 appliance 20, the control system 90 of the FIG. 3 appliance 80 includes a relay 70 having a normally-closed switch 72, but in the FIG. 3 appliance 80, the relay coil 74 is connected across two electrical contacts of a printed circuit board 92 associated with the control circuitry 35 so that upon start-up of operation of the principal operating components of the oven 82, the relay coil 74 responds to a voltage differential generated between the contacts 94, 96 sufficient to open the relay switch 72 which, in turn, prevents the operation of the refrigerator 84 as long as the oven 82 is operating. When, in accordance with commands from the control circuitry 35, a voltage differential ceases to be sensed between the electrical contacts 94, 96 and the oven 82 ceases operation, the relay coil 74 permits the switch 72 to return to its normally closed position which, in turn, permits the refrigerator 84 to operate.

Figure 4:
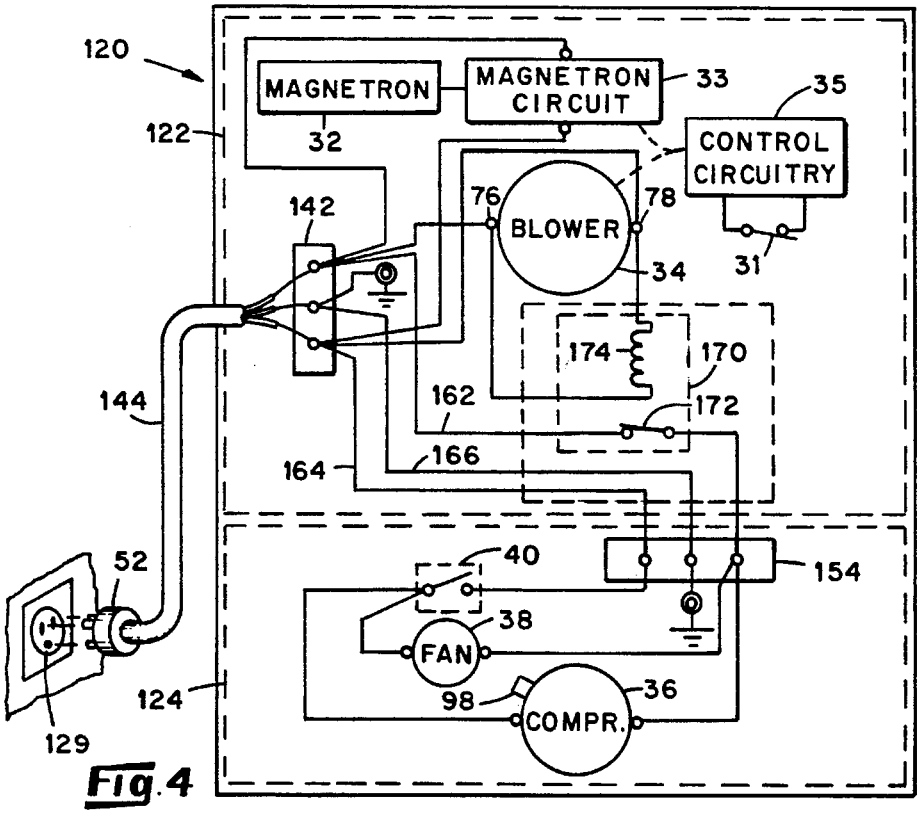
FIG. 4 is a view illustrating schematically the operation of still another refrigerator/microwave oven combination within which still another embodiment of the invention is utilized.

With reference to FIG. 4, there is shown an another appliance, generally indicated 120, within which another embodiment of the invention is utilized. The appliance 120 combines the components of a microwave oven 122 and a refrigerator 124 within a single cabinet and connects the components in such a manner that the refrigerator 124 can withdraw power from an outlet receptacle 129 by way of a single power cord 144. In the appliance 120, there is provided a terminal block 142 to which the power cord 144 is connected and through which the principal operating components of the microwave oven 122 draw electrical power, and the appliance 120 also includes a terminal block 154 through which the operating components of the refrigerator 124 withdraws electrical power. Connected between the terminal blocks 142 and 154 are three wires 162, 164 and 166 for conducting operating power for the refrigerator components from the power cord 144. The principal operating components of the microwave oven 122 and refrigerator 124 are identical to those of the microwave oven 22 and refrigerator 24 of the FIG. 1 appliance 20 and, accordingly, bear the same reference numerals.

In the appliance 120, there is provided a control system 130 which prevents the microwave oven 122 and refrigerator 124 from simultaneously withdrawing power for operation and includes a relay 170 having a normally-closed switch 172 an a coil 174. The switch 172 is connected in-line with the power wire 162, and the coil 174 of the relay 170 is connected across power leads 76, 78 of the blower 34. Therefore, as long as the blower 34 is OFF, the normally-closed switch 172 of the relay 170 remains closed so that operating power for the refrigerator 124 is conducted to the terminal block 154. Conversely, upon switching of the blower ON by the application of power across the leads 76, 78, the relay switch 172 is moved by the relay coil 174 to an opened position thereby shutting off any transmission of refrigerator operating power to the terminal block 154.

It will be understood that numerous modifications and substitutions can be had to the aforedescribed embodiments without departing from the spirit of the invention. In each of the aforedescribed appliance embodiments, the compressor of the refrigerator portions of the appliance is equipped with an internal overload protector switch (see, e.g. overload protector switch 98 of the compressor 36 of the FIG. 2 appliance 20 or the FIG. 4 appliance 120) which prevents damage to the compressor by automatically preventing the compressor from operating if, at some point, the protector switch senses that the compressor is working or must work too hard. The protector switch may be thrown if, after the refrigerator is shut off, it is immediately started up again so that the compressor must work too hard against the pressure which exists on the high pressure side of the compressor. In each of the aforedescribed appliance examples, therefore, the overload protection of the compressor is provided by its overload protector switch.

Figure 5:
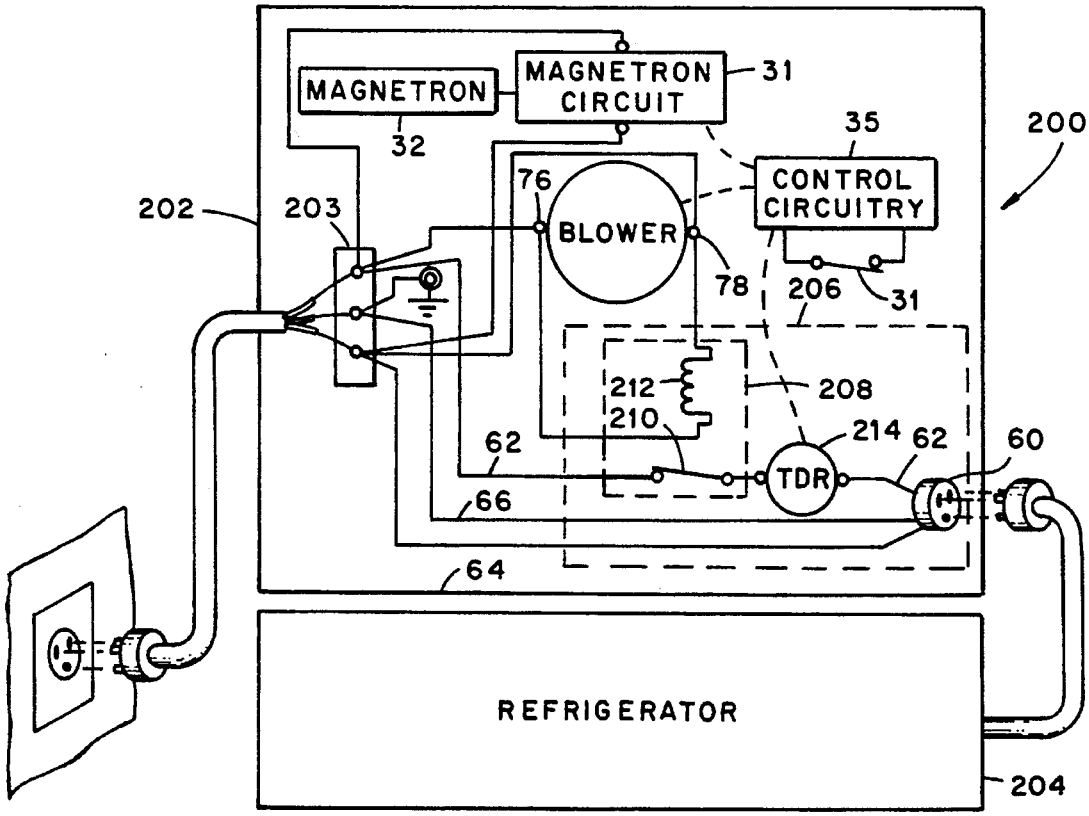
FIG. 5 is a view illustrating schematically the operation of yet another refrigerator/microwave oven combination within which yet another embodiment of the invention is utilized.

However, in order to provide time for the pressure on the high and low sides of the compressor to equalize through the refrigeration coils before operation of the refrigerator compressor is re-initiated, it may be desirable to provide the control system of the present invention with means for preventing the refrigerator from starting up for a preselected amount of time following shut off of the refrigerator. For example, there is shown in FIG. 5 an appliance 200 having a microwave oven 202 having a terminal block 203 and a refrigerator 204 which is adapted to withdraw electrical operating power from the terminal block 203 by way of electrical wires 62, 64 and 66 extending between the terminal block 203 and a receptacle 60. A control system 206 including a time delay relay 214 and a second relay 208 is connected to the power wire 62 for either shutting off or permitting the transmission of electrical power between the terminal block 203 and the receptacle 60. More specifically, the relay 208 includes a normally-closed switch 210 connected in-line with the power wire 62 and a coil 212 which is connected between the power wire 62 and the power leads 76, 78 of the oven blower 34. The time delay relay 214 includes a switch which is also connected in line with the power wire 62 and responsive to signals from the control circuitry 35 for preventing the transmission of power through the wire 62 for a predetermined period of time, e.g. three minutes, following closing of the relay switch 210. Thus, as long as the blower 34 is operating, the relay switch 210 is opened, but following the closing of the relay switch 210, the time delay relay 214 prevents the transmission of power through the wire 62 for an additional period of time. This additional period of time (before power is permitted to be transmitted through the wire 62) provides additional time during which pressures on the high and low sides of the refrigerator compressor may approach equalization before operation of the refrigerator compressor is re-initiated and is believed to reduce the likelihood that the overload protector of the compressor will be thrown upon compressor start-up. Accordingly, the aforedescribed embodiments are intended for the purpose of illustration and not as limitation.

I claim:

1. A control system for coordinating the operation of a microwave oven with that of a second electrical appliance wherein the microwave oven and the second electrical appliance withdraw electrical power for operation from a single electrical power outlet and wherein the microwave oven includes a pair of electrical contacts across which a voltage differential is generated when the microwave oven is in operation and a power cord through which electrical power is conducted to the electrical contacts from the single power outlet, the control system comprising:

wiring connected between the second electrical appliance and the microwave oven for conducting electrical operating power to the second electrical appliance by way of the power cord; and relay means having a normally-closed switch which is connected in line with the wiring connected between the second electrical appliance and the microwave oven and including a coil connected across the electrical contacts of the microwave oven and responsive to the voltage differential generated across the contacts during microwave oven operation so that as long as the microwave oven is operating, the switch of the relay means prevents electrical power to be withdrawn by the second electrical appliance through the wiring so that the power needs of the second electrical appliance yield to the power needs of the microwave oven and as long as the microwave oven is not operating, the switch of the relay means permits electrical power to be withdrawn by the second electrical appliance through the wiring.

2. The system as defined in claim 1 wherein the microwave oven includes a blower having electrical contacts across which a voltage differential is generated when the microwave oven is operating and the electrical contacts across which the coil of the relay is connected are the electrical contacts of the blower.

3. The system as defined in claim 1 wherein the microwave oven includes control circuitry with which the operation of the microwave oven is controlled and the circuitry includes electrical contacts across which a voltage is measurable when the microwave oven is operating and the electrical contacts across which the coil of the relay is connected are the electrical contacts of the control circuitry.

4. The system as defined in claim 1 wherein the wiring includes a receptacle and removable plug received by the receptacle accommodating the manual disconnection of the second electrical appliance from the power cord of the microwave oven.

5. The system as defined in claim 1 wherein the second electrical appliance is a refrigerator and the refrigerator includes a compressor having an overload protector.

6. The system as defined in claim 1 further including time delay means associated with the relay means for preventing transmission of electrical power through the wiring for a predetermined period of time following the closing of the relay switch.

7. A control system for use with a microwave oven and a second electrical appliance enabling the microwave oven and the second appliance to withdraw electrical power from a single power outlet and wherein the microwave oven includes a pair of electrical contacts across which a voltage is generated when the oven is in operation and a power cord through which the electrical power is conducted to the electrical contacts from the single power outlet, the system comprising:

means providing an electric outlet receptacle operatively wired to the microwave oven for receiving electrical power by way of the power cord thereof and through which electrical power is transmitted to the second electrical appliance; and relay means having a normally-closed switch which is connected in line with the wiring of the electric outlet receptacle and having a coil connected to the electrical contacts of the microwave oven for sensing the voltage generated thereacross during microwave oven operation so that as long as the microwave oven is operating, the switch of the relay means is opened thereby preventing electrical power to be withdrawn by the second electrical appliance through the outlet receptacle and so that the power needs of the second electrical appliance through the outlet receptacle yield to the power needs of the microwave oven and as long as the microwave oven is not operating, the switch of the relay means is closed thereby permitting electrical power to be withdrawn by the second electrical appliance from the outlet receptacle.

8. The system as defined in claim 7 wherein the microwave oven includes a blower having electrical contacts across which a voltage is generated when the microwave oven is operating and the electrical contacts across which the coil of the relay is connected are the electrical contacts of the blower.

9. The system as defined in claim 7 wherein the microwave oven includes control circuitry with which the operation of the microwave oven is controlled and the circuitry includes electrical contacts across which a voltage is generated when the microwave oven is operating and the electrical contacts across which the coil of the relay is connected are the electrical contacts of the control circuitry.

10. The system as defined in claim 7 wherein the power cord of the microwave oven is a first power cord and the second electrical appliance includes a second power cord terminating in a plug, and the plug is removably receivable by the electric outlet receptacle for conducting electrical operating power from the outlet receptacle to the second electrical appliance.

11. The system as defined in claim 7 wherein the second electrical appliance is a refrigerator.

12. The system as defined in claim 7 further including time delay means associated with the relay means for preventing transmission of electrical power through the outlet receptacle for a predetermined period of time following the closing of the relay switch.

13. In a microwave oven including electrical contacts across which a voltage differential is generated when the oven is in operation and a power cord connectable to a single power outlet and through which electrical power is conducted to the electrical contacts from a single power outlet during operation of the oven, the improvement comprising:

means providing an electric outlet receptacle operatively wired to the power cord of the microwave oven for receiving electrical power therefrom, and an electrical relay including a normally-closed switch wired in-line with the wiring of the electric outlet receptacle and a coil wired across the electrical contacts of the microwave oven for sensing the voltage differential generated thereacross so that as long as the microwave oven is operating, the switch of the relay prevents power from being conducted through the power cord of the microwave oven to the electric outlet receptacle and so that as long as the microwave oven is not operating, the switch of the relay permits power to be withdrawn from the outlet receptacle so that when a second electrical appliance is plugged into the electric outlet receptacle, the relay prevents simultaneous operation of the microwave oven and the second electrical appliance and the power needs of the second electrical appliance yield to the power needs of the microwave oven.

14. The improvement as defined in claim 13 wherein the microwave oven includes a blower having electrical contacts across which a voltage differential is generated when the microwave oven is operating and the electrical contacts across which the coil of the relay is connected are the electrical contacts of the blower.

15. The improvement as defined in claim 13 wherein the microwave oven includes control circuitry for controlling the operation of the microwave oven and the circuitry includes electrical contacts across which a voltage differential is generated when the microwave oven is operating and the electrical contacts across which the coil of the relay is connected are the electrical contacts of the control circuitry.

16. The improvement as defined in claim 13 further including time delay means associated with the relay for preventing transmission of electrical power through the power cord of the microwave oven to the electric outlet receptacle for a predetermined period of time following the closing of the relay switch.

* * * * *